US008136610B2

(12) United States Patent
Jeffryes

(10) Patent No.: US 8,136,610 B2
(45) Date of Patent: Mar. 20, 2012

(54) TORSIONAL RESONANCE PREVENTION

(75) Inventor: Benjamin Jeffryes, Histon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/406,528

(22) Filed: Mar. 18, 2009

(65) Prior Publication Data

US 2009/0266608 A1 Oct. 29, 2009

(30) Foreign Application Priority Data

Apr. 26, 2008 (GB) ..... 0807638.2

(51) Int. Cl.
*E21B 47/00* (2006.01)

(52) U.S. Cl. ..... 175/40; 175/24; 175/45

(58) Field of Classification Search ..... 175/27, 175/40, 220

See application file for complete search history.

(56) References Cited

U.S. PATENT DOCUMENTS

| | | | | |
|---|---|---|---|---|
| 5,117,926 | A | 6/1992 | Worrall et al. | |
| 6,206,108 | B1 * | 3/2001 | MacDonald et al. | 175/24 |
| 6,435,286 | B1 * | 8/2002 | Stump et al. | 175/26 |
| 2005/0071120 | A1 | 3/2005 | Hutchinson | |

FOREIGN PATENT DOCUMENTS

| | | | |
|---|---|---|---|
| EP | 0870899 | A1 | 10/1998 |
| EP | 0999346 | A2 | 5/2000 |
| GB | 2275283 | A | 8/1994 |
| WO | 03089759 | A1 | 10/2003 |
| WO | 2007149866 | A2 | 12/2007 |

OTHER PUBLICATIONS

Halsey et al, "Torque feedback used to cure slip-stick motion", 63rd Annual Technical Conference and Exhibition of the Society of Petroleum Engineers, Houston, TX, Oct. 2-5, 1988, SPE 18049.

Jansen et al, "Active damping of self-excited torsional vibrations in oil well drillstrings", Journal of Sound and Vibration, vol. 179, No. 4, 1995, pp. 647-668.

Selesnick et al, "Generalized digital Butterworth filter design", IEEE Transactions on Signal Processing, vol. 46, No. 6, Jun. 1998, pp. 1688-1694.

* cited by examiner

*Primary Examiner* — Jennifer H Gay
*Assistant Examiner* — Yong-Suk Ro

(57) ABSTRACT

A system for drilling a cavity in a medium. The system may include a drill bit, a processor, and a controller. The drill bit may be configured to rotate in the medium and remove at least a portion of the medium. The processor may be configured to receive a first set of data representative of a variable rotational speed of the drill bit during a length of time in the medium, and determine, based at least in part on the first set of data, a first resonant frequency of the variable rotational speed of the drill bit. The controller may be configured to receive a second set of data representative of the first resonant frequency of the variable rotational speed of the drill bit, and vary the force applied to the drill bit based at least in part on the second set of data.

18 Claims, 3 Drawing Sheets

TORSIONAL RESONANCE PREVENTION

BACKGROUND OF THE INVENTION

This invention relates generally to drilling. More specifically the invention relates to drilling in earthen formations.

When drilling in hard mediums, for example earthen formations, a common problem is rotational vibration caused by a "stick-slip" condition. Stick-slip occurs when the drill bit either "bites" too much or too little of the medium to cause further boring into the medium. When the drill bit bites too much of the medium, each of the cutters on the drill bit is engaging too much medium without enough torque to cause the medium to either be sheared or otherwise removed from the cavity. When the drill bit bites too little of the medium, the path of least resistance for the drill bits may be to skip over the medium rather than remove material from the cavity. Both stick and slip occurrences will cause torsional vibrations in the drillstring connecting the drill bit to the drill's rotational power source.

Torsional vibrations can be so severe as to stop the bit from moving forward, for example, when a backward vibration is equal to the forward rate of rotation. Once this occurs, the difference between the static and dynamic friction characteristics of the drill bit on the medium can make the oscillations self sustaining. Torsional vibrations caused by stick-slip can also reduce the speed at which a cavity is drilled into the medium. Furthermore, such torsional vibrations can reduce the life of the drill bit and associated drilling equipment, such as for example the rotational power source.

While the properties of the medium may at least partially affect the likelihood of stick-slip occurring, the properties of the medium may not be controllable, especially in earthen drilling operations. However, the amount of torque may also at least partially affect the likelihood of stick-slip occurring, and may be controlled.

BRIEF DESCRIPTION OF THE INVENTION

In one embodiment of the present invention, a system for drilling a cavity in a medium is provided. The system may include a drill bit, a drillstring, a processor, and a controller. The drill bit may be configured to rotate in the medium and remove at least a portion of the medium to at least partially define the cavity. The drillstring may be coupled with the drill bit, and may be configured to receive a rotational motion, rotate the drill bit, and apply a force to the drill bit. The processor may be configured to receive a first set of data representative of a variable rotational speed of the drill bit during a length of time in the medium. The processor may be further configured to determine, based at least in part on the first set of data, a first resonant frequency of the variable rotational speed of the drill bit. The controller may be configured to receive a second set of data representative of the first resonant frequency of the variable rotational speed of the drill bit. The controller may be further configured to vary the force applied to the drill bit by the drillstring based at least in part on the second set of data.

In another embodiment, a method for drilling a cavity in a medium is provided. The method may include rotating a drill bit in the medium and applying a force to the drill bit. The method may also include removing at least a portion of the medium to at least partially define the cavity. The method may further include determining a first set of data based at least in part on the variable rotational speed of the drill bit during a length of time in the medium. The method may additionally include determining, based at least in part on the first set of data, a second set of data representative of a first resonant frequency of the variable rotational speed of the drill bit. The method may moreover include varying the force applied to the drill bit by based at least in part on the second set of data.

In another embodiment, a system for drilling a cavity in a medium is provided. The system may include a first means, a second means, and a third means. The first means may be for removing at least a portion of the medium to at least partially define the cavity. The second means may be for determining a first resonant frequency of a variable rotational speed of the first means. The third means may be for varying a force applied to the first means based at least in part on the first resonant frequency.

BRIEF DESCRIPTION OF THE DRAWINGS

The present invention is described in conjunction with the appended figures.

Figure 1:
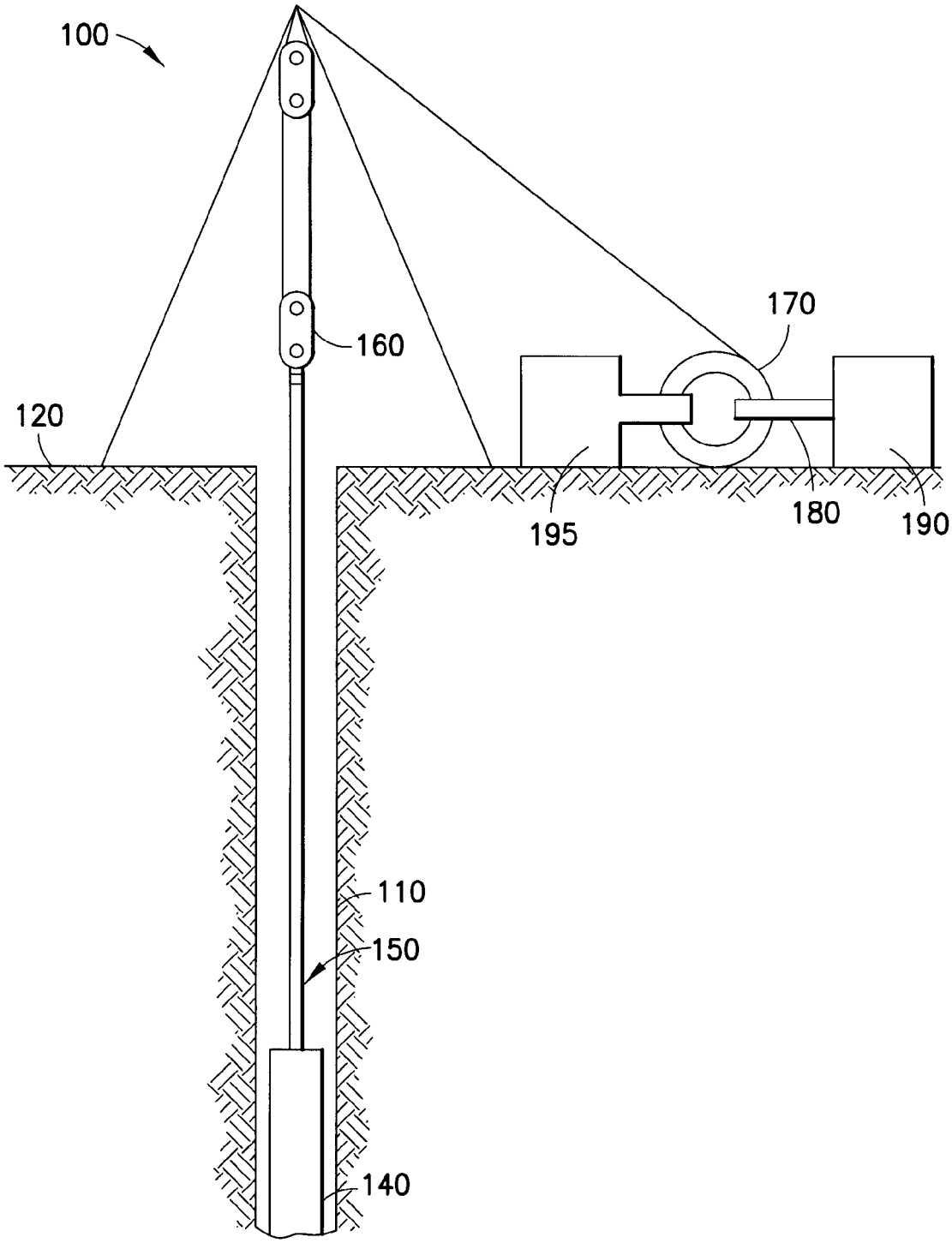
FIG. 1 is a side view of a system embodiment of the invention for drilling a cavity in a medium while preventing torsional resonance, the system having a drill bit, a bottom hole assembly, a drillstring, a traveling block, a drum and a brake.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, circuits, systems, networks, processes, and other elements in the invention may be shown as components in block diagram form in order not to obscure the embodiments in unnecessary detail. In other instances, well-known circuits, processes, algorithms, structures, and techniques may be shown without unnecessary detail in order to avoid obscuring the embodiments.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments. A process may correspond to a method, a function, a procedure, a subroutine, a subprogram, etc. When a process corresponds to a function, its termination corresponds to a return of the function to the calling function or the main function.

Furthermore, embodiments of the invention may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

In one embodiment of the invention, a system for drilling a cavity in a medium is provided. The system may include at least one drill bit, a drillstring, a processor, and a controller. Merely by way of example, the medium into which the cavity may be drilled may be an earthen formation. The cavity may be include vertical, horizontal, straight and/or curved passages with varying cross sectional sizes and possibly shapes.

In some embodiments, the drill bit may be configured to rotate in the medium and remove at least a portion of the medium to at least partially define the cavity. Merely by way of example, the drill bit may include differing types of cutters, including solid fixed cutter, a roller-cone cutter, and/or a polycrystalline diamond compact cutter. In some embodiments, snubbers may also be included in the drill bit to alter the characteristics of the drilling process through the medium.

In some embodiments, the drillstring may be coupled with the drill bit, and may be configured to receive a rotational motion, rotate the drill bit, and apply a force to the drill bit. Merely by way of example, the drillstring may include a bottomhole assembly and drill pipe or tubing. The drillstring may be rotated by a rotary table and/or a topdrive system.

Force (for example, weight in vertical-type applications) may be applied to the drill bit by the drillstring and may be increased in certain applications via additions to the drillstring such as weight collars. The amount of force applied to the drill bit may vary with the lowering of a traveling block (for example, a pulley system) which is attached via cable to a drum which, when rotated, can lower and raise the traveling block. As the traveling block is lowered, more force may be applied to the drill bit as the medium takes up more of the weight of the bit not being held by the traveling block and corresponding cabling system.

In some embodiments, the traveling block may not be configured to be moved upward during actual downhole turning drilling operations into the medium. In these embodiments, the force on the drill bit may be reduced by holding the traveling block steady and at least partially maintaining the spatial position of the drillstring, or at least a top portion of the drillstring.

In other embodiments, the force applied to the drill bit may be reduced by moving the top of the drillstring upwards, while actively continuing with the drilling operation. Merely by way of example, rack-and-pinion systems, hydraulic systems, and/or other means may be employed to axially move the drillstring in reverse directions, upwards, during turning of the drillstring in drilling operations.

In some embodiments, the processor may be configured to receive a first set of data representative of a variable rotational speed of the drill bit during a length of time in the medium. The processor may be further configured to determine, based at least in part on the first set of data, a first resonant frequency of the variable rotational speed of the drill bit. The processor may also be configured to determine a second set of data representative of the first resonant frequency of the variable rotational speed of the drill bit. In some embodiments, the second set of data may also include information representative of other resonant frequencies beyond and possibly including the first resonant frequency.

In some embodiments, the processor may be located in proximity to the drill bit. In one of these embodiments, the processor may be located in the bottomhole assembly. In another embodiment, the processor may be located remote from the drill bit, possibly above ground near or in unison with the controller.

In some embodiments, the system may also include a speed sensing device. The processor may be in communication with the speed sensing device. In some embodiments, the speed sensing device may also be located in proximity to the drill bit. The speed sensing device may be configured to determine the variable rotational speed of the drill bit. In some embodiments, the speed sensing device may be configured to determine the first set of data which is representative of the variable rotational speed of the drill bit during the length of time in the medium. Merely by way of example, the speed sensing device may include a magnetometer which measures the rate-of-change of angle to the earth's magnetic field, or one or more accelerometers orientated on the rotational axis of the bore hole assembly or other portion of the system.

In some embodiments, the controller may be configured to receive the second set of data and vary the force applied to the drill bit by the drillstring based at least in part on the second set of data. In these and other embodiments, the controller may be located remotely from the processor. In an earthen drilling example, the controller may be located above the surface and control the rotational drive which turns the drillstring. Data or information from the processor may be received from the processor telemetrically, for example, by low-rate telemetry methods such as mud-pulse systems, electromagnetic systems; or by high-rate telemetry methods such as inductively coupled wired pipe or continuous wire.

In some embodiments, the controller may control a brake which is coupled with the drillstring and controls the speed lowering of the drillstring. In one embodiment, the brake may control rotation of the drum discussed above. By varying the drop rate of the cable coupled with both the drum and the traveling block, the brake may vary the force applied to the drill bit by the drillstring. Therefore, in embodiments with a brake, the controlled may be configured to control the brake to vary the force applied to the drill bit by the drillstring.

In some embodiments the controller may include a band-stop or notch filter. The band-stop or notch filter may remove the resonant frequency or frequencies represented by the second set of data from variance of the force applied by the drillstring to the drill bit. In this manner, torsional resonance may at least be reduced from system operation. In some embodiments, the systems of the invention may be complimented by systems which allow rotational vibration of the drill bit and/or drillstring to escape through a use of a feedback controller at the drive system of the drillstring.

In some embodiments, the processor may be further configured to monitor a weight or a torque of at least one or more of the drillstring and drill bit and determine a second resonant frequency or set of resonant frequencies of the variable rotational speed of the drill bit, based at least in part on the first set of data and at least one of the weight and the torque. In these or other embodiments, the controller may be further configured to receive a third set of data representative of the second resonant frequency or set of resonant frequencies of the variable rotational speed of the drill bit, and vary the force applied to the drill bit by the drillstring based at least in part on the third set of data.

In another embodiment of the invention, a method for drilling a cavity in a medium is provided. The method may include rotating a drill bit in the medium and applying a force to the drill bit. The method may also include removing at least a portion of the medium to at least partially define the cavity.

In some embodiments, the method may further include determining a first set of data based at least in part on the variable rotational speed of the drill bit during a length of time in the medium. In one embodiment, the variable rotational speed of the drill may be determined through the use of the systems and or sub-systems described herein.

In some embodiments, the method may additionally include determining, based at least in part on the first set of data, a second set of data representative of a first resonant frequency or set of resonant frequencies of the variable rotational speed of the drill bit. In one embodiment, varying the force applied to the drill bit by based at least in part on the second set of data may occur remotely from determining the first set of data based at least in part on the variable rotational speed of the drill bit during a length of time in the medium. Merely by way of example, a processor in the bottomhole assembly may determine the first resonant frequency or set of resonant frequencies, while a controller may use the first set of data remotely to control the movement of the drill bit.

In some embodiments, the method may moreover include varying the force applied to the drill bit by based at least in part on the second set of data. In one embodiment, varying the force applied to the drill bit may include filtering the first resonant frequency from the variance of force applied to the drill bit. In another embodiment, a set of resonant frequencies may be filtered from the variance of force applied to the drill bit.

In some embodiments, varying the force applied to the drill bit may include controlling a brake coupled with the drill bit. In this or other embodiments, the method may include decreasing the force applied to the drill bit by the drillstring. While in some embodiments pulling back the drill bit from the medium may not be possible during forward turning of the drill bit, in other embodiments, such operation may be possible. Therefore, in some embodiments, decreasing the force applied to the drill bit by the drillstring may include maintaining the spatial position of the drillstring, possibly by completely braking axial motion of the drill bit, while in other embodiments, pulling back the drillstring while still rotating forward may be possible.

In some embodiments, the method may also include monitoring a weight or a torque at the drill bit and determining a second resonant frequency or set of resonant frequencies of the variable rotational speed of the drill bit, based at least in part on the first set of data and at least one of the weight and the torque. A third set of data may be determined which is representative of the second resonant frequency or set of resonant frequencies of the variable rotational speed of the drill bit, and the force applied to the drill bit may be varied based at least in part on the third set of data.

In another embodiment of the invention, a system for drilling a cavity in a medium is provided. The system may include a first means, a second means, and a third means.

In some embodiments, the first means may be for removing at least a portion of the medium to at least partially define the cavity. Merely by way of example, the first means may include the drill bits discussed herein, the drillstrings discussed herein, another component discussed herein, and/or any other device or mechanism.

In some embodiments, the second means may be for determining a first resonant frequency of a variable rotational speed of the first means. Merely by way of example, the second means may include the processors discussed herein, another component discussed herein, and/or any other device or mechanism. In one embodiment, the processor may be configured to receive a first set of data representative of a variable rotational speed of the first means during a length of time in the medium and determine, based at least in part on the first set of data, the first resonant frequency of the variable rotational speed of the first means.

In some embodiments, the third means may be for varying a force applied to the first means based at least in part on the first resonant frequency. Merely by way of example, the third means may include the controllers discussed herein, another component discussed herein, and/or any other device or mechanism. In one embodiment, the controller may be configured to receive a second set of data representative of the first resonant frequency of the variable rotational speed of the first means and vary the force applied to the first means based at least in part on the second set of data.

In some embodiments, the system may also include a fourth means for determining a variable rotational speed of the first means. Merely by way of example, the fourth means may include the speed sensing devices, magnetometers, and/or accelerometers discussed herein, another component discussed herein, and/or any other device or mechanism.

In some embodiments, the system may also include a fifth means for determining a weight and or torque at the first means. Merely by way of example, the fifth means may include the strain gauges discussed herein, another component discussed herein, and/or any other device or mechanism.

Turning now to FIG. 1, a side view of a system 100 of the invention for drilling a cavity 110 in a medium 120 while preventing torsional resonance, system 100 having a drill bit 130, a bottom hole assembly 140, a drillstring 150, a traveling block 160, a drum 170, a brake 180, and a controller 190. System 100 may also include movement subsystem 195, which may allow for axial movement of drillstring 150 during drilling. In this example, movement subsystem 195 may at least assist in upward and/or downward movement of drillstring 150 during turning of drillstring 150. In some embodiments, movement subsystem 195 may be fully responsible for axial movement (for example, upward and downward movement) of drillstring 150 prior-to, during, and/or after drilling.

As a rotary table, a topdrive, or other rotational mechanism rotates drillstring 150, bottomhole assembly 140 and drill bit 130 rotate, removing medium 120 and creating cavity 110. As discussed above, torsional vibration along with stick-slip may occur, causing a reduced rate of drilling depth speed.

A significant factor in producing rotational oscillations may include variations in torque at drill bit 130. Variations in torque may be produced by two primary sources, variations in both the properties of the material, which may be anisotropic, and the amount of weight on the drill bit. The weight on the bit ("WOB") may be affected by at least the weight of bottomhole assembly 140, the weight of drillstring 150, and the movement of traveling block 160 as controlled by drum 170, brake 180, and controller 190. Because variations in torque may be linear with respect to WOB, variations in WOB may translate proportionally into variations in torque.

Thus, an equation that describes a model of the system shown in FIG. 1 as a lightly-damped resonant system driven by torque at drill bit 130 may be:

$$\dot{\phi} \propto \mathrm{real}\left(\frac{d}{dt}\int_0^{\infty} T(t-\tau)\exp(-\lambda\tau)\sin(2\pi i f\tau)\,d\tau\right)$$

where $\phi$ may be the angle (and hence $\dot{\phi}$ may be the rotational angular velocity), T may be the torque, t may be the time, $\lambda$ may be the damping coefficient, and f may be the resonant frequency.

From this equation it will now be understood that to the fluctuations in the rotational velocity may be reduced significantly by reducing the fluctuations that occur at the resonant frequency. In one embodiment, these fluctuations may be affected by controlling the movement of traveling block 160 which affects the WOB. In some embodiments, such as the one shown in FIG. 1, this may be controlled by a brake on a drum cabled to traveling lock 160.

In some embodiments, raising drillstring 150 may not be possible during drilling operations. In these embodiments, it may be that traveling block 160 may only be lowered and not raised. In these embodiments, any desired upward motion by controller 190 may be replaced with traveling block 160 remaining stationary, thereby decreasing the WOB without removing it entirely.

In other embodiments, a system may be used to raise the drillstring during the drilling operation. In such embodiments, the force applied to the drill bit may be reduced by moving the top of the drillstring upwards, while actively continuing with the drilling operation. Systems for raiding the drillings during the drilling process may include rack-and-pinion systems, hydraulic systems, and/or other means may be employed to axially move the drillstring in reverse directions, upwards, during turning of the drillstring in drilling operations. Merely by way of example, a top drive for driving the drillstring to rotate, a rotary table or the like may be axially moveable during a drilling process to provide for axial motion of the drillstring during the drilling process.

In some embodiments, the dominant or other resonant frequencies of the rotational oscillations may vary along the length of drillstring 150. In some embodiments, the dominant or other resonant frequencies of drillstring 150 may be determined by either calculation from the physical properties of system 100, or observation of system 100 under operating conditions. In some embodiments, observation of the top of drillstring 150 may suffice, but in other embodiments, observation of conditions in proximity to bottomhole assembly 140 may provide increased accurate determination of dominant or other resonant frequencies.

Figure 2:
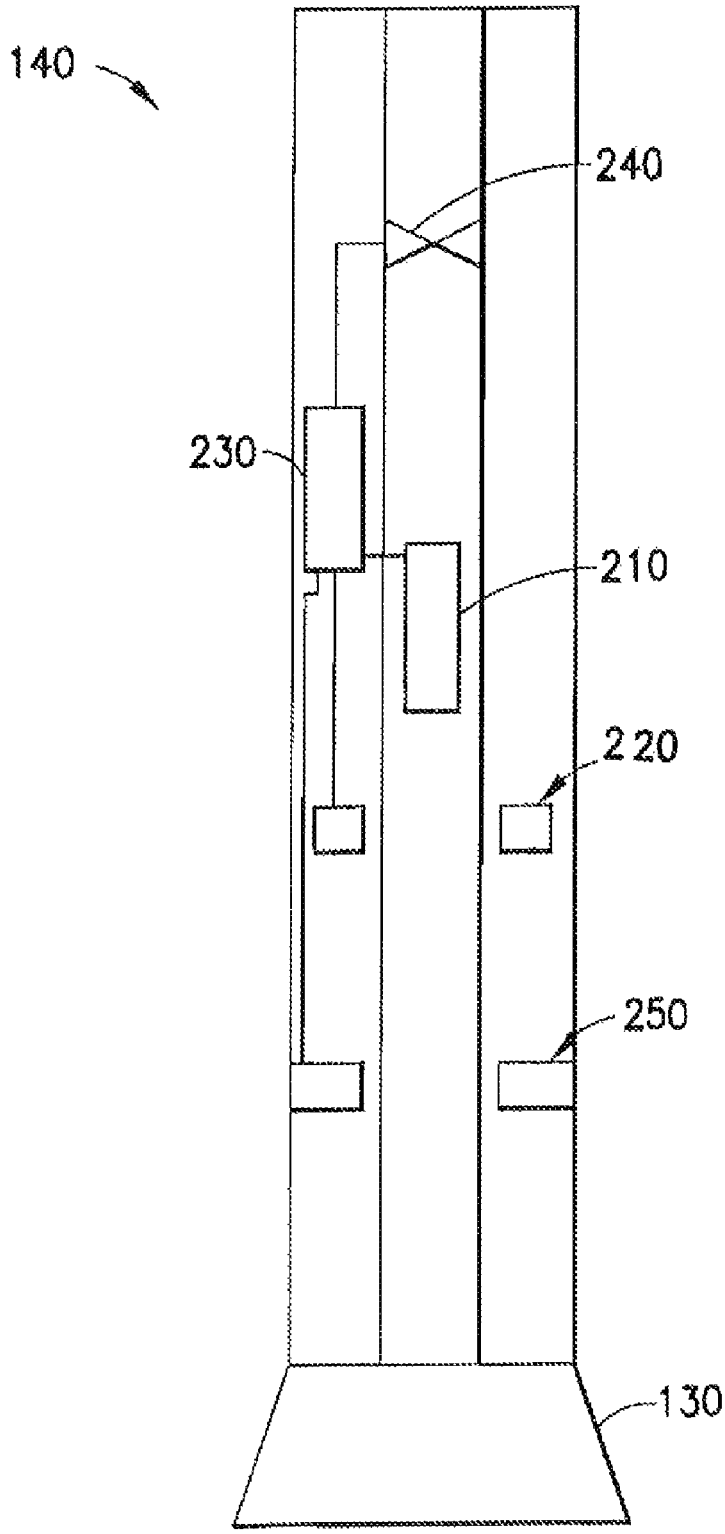
FIG. 2 is a side cut-away block diagram view of the bottom hole assembly of FIG. 1.

FIG. 2 shows a side cut-away block diagram view of bottomhole assembly 140 from FIG. 1. This bottomhole assembly 140 may contain processors and devices in communication with such processors to determine parameters of rotational oscillations in proximity to drill bit 140. In this embodiment, rotational speed may be measured by employing either magnetometers 210 which detect the earth's magnetic field, or by using one or more accelerometers 220 oriented around the rotational axis of bottomhole assembly 140.

In some embodiments, data from either magnetometers 210, accelerometers 220, or other device may be transmitted to processor 230, where the dominant and other resonant frequencies may be determined. This data may then be transmitted to controller 190, which may be at the surface above cavity 110. In some embodiments, a mud-pulse telemetry pulser 240 may be used to transmit the relevant data to the surface.

In some embodiments, additional characteristics of down hole operation, for example, weight and torque at drill bit 130, may be determined by strain gauges or other devices 250. Either at processor 230 or controller 190, the ratio of the spectrum of the rotational speed to weight, torque, or other measured quantity may allow the dominant or other resonant frequencies to be determined even while rotational oscillations are being inhibited by processor 230 and/or controller 190. This additional information may be transmitted to controller 190 to continually adjust which dominant frequencies are filtered from operation.

Figure 3:
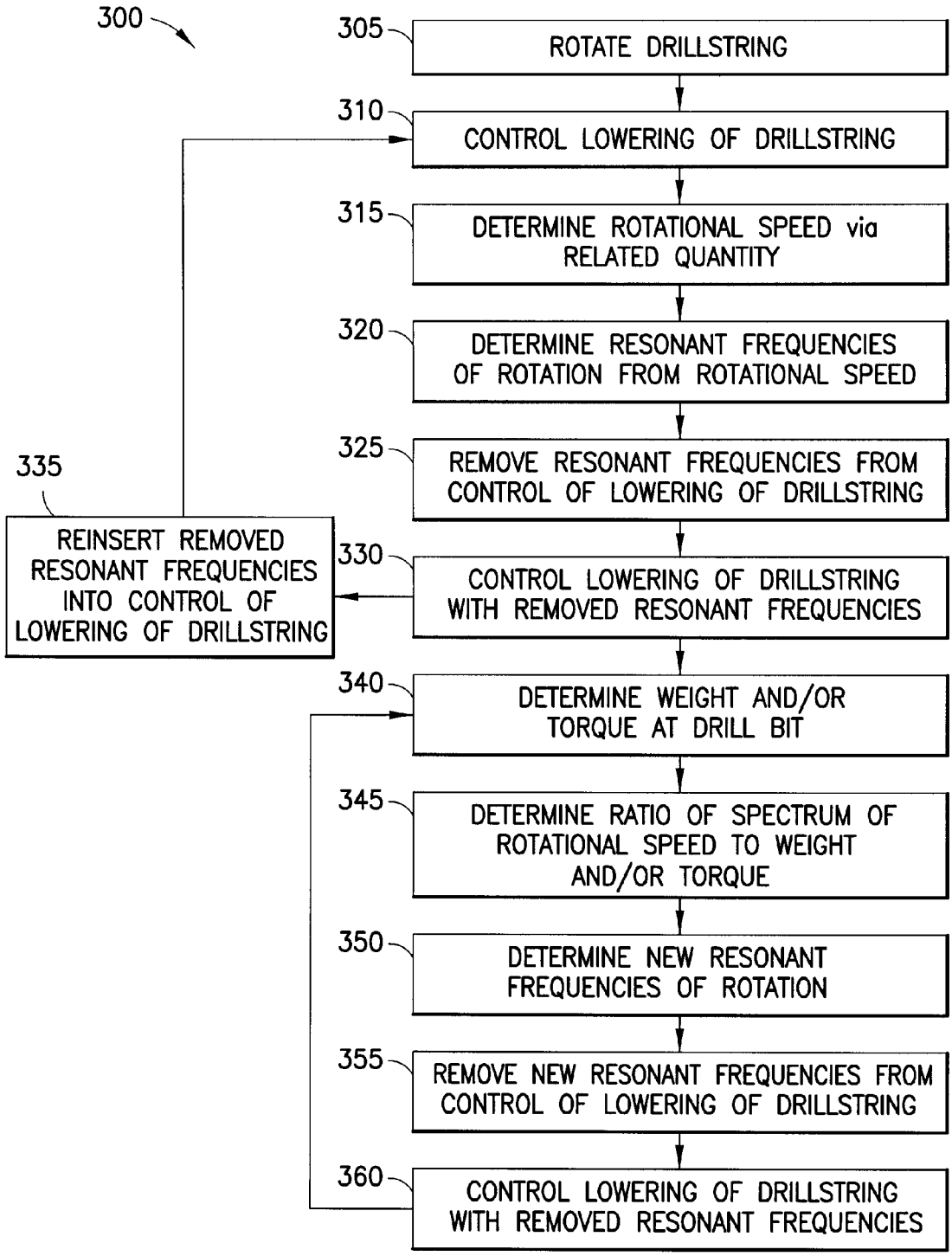
FIG. 3 is a block diagram of a method embodiment of the invention for drilling a cavity in a medium which prevents torsional resonance.

FIG. 3 shows a block diagram of a method 300 of the invention for drilling a cavity 110 in a medium 120 which prevents torsional resonance. At block 305, the drillstring 150 is rotated 305, for example, by a rotary table or topdrive system. At block 310, drillstring 150 is lowered via a control mechanism, for example, by a controller 190, brake 180 and drum 170 mechanisms. By lowering drillstring 150, the WOB is increased and hence the torque at drill bit 130.

At block 315, the rotational speed of the drill bit 130 at the bottom of drillstring 150 is determined, possibly by using magnetometers 210 and/or accelerometers 220. At block 320, one or more resonant frequencies of the rotation of drill bit 130 are determined, for example, by a processor 230 in communication with the magnetometers 210 and/or accelerometers 220. Communication may be provided by a telemetry system, wired drill pipe and/or the like.

At block 325, the determined resonant frequencies are removed from the variable rate lowering of drillstring 150, possibly by controller 190. At block 330, the lowering of drillstring 150 is continued, with the resonant frequencies removed from the variable lowering rate of drillstring 150.

In some embodiments, the resonant frequencies may be variable as drill bit 130 progresses deeper into the medium. In one or more of these embodiments, at block 335, the resonant frequencies which were previously removed from the control of the lowering drillstring 150 may be reinserted, and the process from block 305 to block 330 repeated. In this manner, the new resonant frequencies of the system may be determined and thereafter used to control the system to reduce torsional resonance.

In these or other embodiments, the reinserting of the resonant frequencies into the control scheme may not occur, or may occur only at certain intervals. In these embodiments, another method may be used to adjust which resonant frequencies are removed from control of the lowering (and hence WOB and torque) of drill bit 130. At block 340, the weight and/or torque at drill bit 130 is determined, possibly via strain gauges or other devices 250 and processor 230.

At block 345, a ratio of the spectrum of rotational speed to the weight and/or torque is determined, possibly at processor 230. From this determined ratio, new and/or adjusted resonant frequencies may be determined at block 350, and may be determined in the system, for example, by processor 230. At block 355, those new and/or adjusted resonant frequencies may be removed from the variable rate lowering of drillstring 150, possibly by controller 190. At block 360, the lowering of drillstring 150 is continued, with the new and/or adjusted resonant frequencies removed from the variable lowering rate of drillstring 150. In steps 310, 330 and/or 360, controlled lowering of the drillstring may comprise moving the drillstring axially in the borehole in an upward or downward direction.

The invention has now been described in detail for the purposes of clarity and understanding. However, it will be appreciated that certain changes and modifications may be practiced within the scope of the appended claims.

What is claimed is:

1. A system for drilling a cavity in a medium, wherein the system comprises:

a drill bit, wherein the drill bit is configured to:

rotate in the medium; and remove at least a portion of the medium to at least partially define the cavity;

a drillstring coupled with the drill bit, wherein the drillstring is configured to:

receive a rotational motion;

rotate the drill bit; and apply a force to the drill bit;

a processor, wherein the processor is configured to:

receive a first set of data representative of a variable rotational speed of the drill bit during a length of time in the medium; and determine, based at least in part on the first set of data, a first resonant frequency of the variable rotational speed of the drill bit; and a controller, wherein the controlled is configured to:

receive a second set of data representative of the first resonant frequency of the variable rotational speed of the drill bit; and vary the force applied to the drill bit by the drillstring using a band-stop filter to remove the first resonant frequency from the variance of force applied to the drill bit by the drillstring.

2. The system for drilling a cavity in a medium of claim 1, wherein the system further comprises a brake, wherein the brake is coupled with the drillstring, and wherein the brake is configured to vary the force applied to the drill bit by the drillstring.

3. The system for drilling a cavity in a medium of claim 2, wherein the controller is configured to control the brake.

4. The system for drilling a cavity in a medium of claim 1, wherein the band-stop filter is configured to remove the first resonant frequency from the variance of force applied to the drill bit by the drillstring.

5. The system for drilling a cavity in a medium of claim 1, wherein the controller is further configured to decrease the force applied to the drill bit by the drillstring.

6. The system for drilling a cavity in a medium of claim 5, wherein the controller being configured to decrease the force applied to the drill bit by the drillstring comprises the controller being configured to maintain the spatial position of the drillstring.

7. The system for drilling a cavity in a medium of claim 1, wherein the drillstring is configured to move in two different axial directions during drilling operations.

8. The system for drilling a cavity in a medium of claim 7, wherein the controller is configured to control the drillstring to move axially during the drilling operation to vary the force applied to the drill bit by the drillstring.

9. The system for drilling a cavity in a medium of claim 1, wherein the system further comprises a speed sensing device, wherein the speed sensing device is configured to:

determine the variable rotational speed of the drill bit; and determine the first set of data representative of the variable rotational speed of the drill bit during the length of time in the medium.

10. The system for drilling a cavity in a medium of claim 9, wherein the speed sensing device and the processor are coupled with the drillstring in proximity to the drill bit.

11. The system for drilling a cavity in a medium of claim 10, wherein the second set of data is telemetrically transmitted from the processor to the controller.

12. The system for drilling a cavity in a medium of claim 1, wherein:

the processor is further configured to:

monitor a weight or a torque of at least the drillstring; and determine a second resonant frequency of the variable rotational speed of the drill bit, based at least in part on the first set of data and at least one of the weight and the torque; and the controller is further configured to:

receive a third set of data representative of the second resonant frequency of the variable rotational speed of the drill bit; and vary the force applied to the drill bit by the drillstring based at least in part on the third set of data.

13. A method for drilling a cavity in a medium, wherein the method comprises:

rotating a drill bit in the medium;

applying a force to the drill bit;

removing at least a portion of the medium to at least partially define the cavity;

determining a first set of data based at least in part on the variable rotational speed of the drill bit during a length of time in the medium;

determining, based at least in part on the first set of data, a second set of data representative of a first resonant frequency of the variable rotational speed of the drill bit; and varying the force applied to the drill bit based at least in part on the second set of data, wherein the step of varying the force applied to the drill bit based at least in part on the second set of data comprises filtering the first resonant frequency from a variance of force applied to the drill bit.

14. The method for drilling a cavity in a medium of claim 13, wherein varying the force applied to the drill bit comprises controlling a brake coupled with the drill bit.

15. The method for drilling a cavity in a medium of claim 13, wherein the method further comprises decreasing the force applied to the drill bit.

16. The method for drilling a cavity in a medium of claim 13, wherein applying a force to the drill bit comprises selectively moving the drill bit in two different axial directions during drilling operations.

17. The method for drilling a cavity in a medium of claim 13, wherein the determining the first set of data based at least in part on the variable rotational speed of the drill bit during a length of time in the medium occurs remotely from varying the force applied to the drill bit by based at least in part on the second set of data.

18. The method for drilling a cavity in a medium of claim 13, wherein the method further comprises:

monitoring a weight or a torque at the drill bit;

determining a second resonant frequency of the variable rotational speed of the drill bit, based at least in part on the first set of data and at least one of the weight and the torque;

determining a third set of data representative of the second resonant frequency of the variable rotational speed of the drill bit; and varying the force applied to the drill bit based at least in part on the third set of data.

* * * * *